US005148666A

United States Patent [19]

Bauer et al.

[11] Patent Number: 5,148,666

[45] Date of Patent: Sep. 22, 1992

[54] YARN HEATING APPARATUS

[75] Inventors: Karl Bauer, Remscheid; Klaus Bartkowiak, Herne; Peter Dammann; Herbert Streppel, both of Remscheid; Siegfried Morhenne, Breckerfeld, all of Fed. Rep. of Germany

[73] Assignee: Barmag AG, Remscheid, Fed. Rep. of Germany

[21] Appl. No.: 564,196

[22] Filed: Aug. 8, 1990

[30] Foreign Application Priority Data

Aug. 9, 1989 [DE] Fed. Rep. of Germany ..... 3926316
Jun. 29, 1990 [DE] Fed. Rep. of Germany ..... 4020706

[51] Int. Cl.[5] ..... D01H 13/26; D02G 3/02
[52] U.S. Cl. ..... 57/290; 57/284
[58] Field of Search ..... 57/282, 284, 287, 288, 57/289, 290

[56] References Cited

U.S. PATENT DOCUMENTS 2,990,670 7/1961 Kingsbury ..... 57/284
2,991,614 7/1961 Ubbelohde ..... 57/284 X
3,535,866 10/1970 Tsuruta et al. ..... 57/289 X
4,398,386 8/1983 Endo et al. ..... 57/288
4,534,164 8/1985 Toshimasa et al. ..... 57/282 X
4,539,805 9/1985 Ukai et al. ..... 57/287 X
4,567,721 2/1986 Kuroda et al. ..... 57/284

FOREIGN PATENT DOCUMENTS 2314975 10/1974 Fed. Rep. of Germany .
47-42065 10/1972 Japan ..... 57/246
58-191229 11/1983 Japan ..... 57/284
890057 2/1962 United Kingdom .

*Primary Examiner*—Daniel P. Stodola
*Assistant Examiner*—Michael R. Mansen
*Attorney, Agent, or Firm*—Bell, Seltzer, Park & Gibson

[57] ABSTRACT

A yarn heating apparatus which is adapted for use in a yarn false twisting machine. The heating apparatus includes an elongate heating surface, and a plurality of yarn guide members mounted in a longitudinally spaced-apart arrangement along the length of the heating surface, for guiding an advancing yarn therealong in a laterally zigzagged path of travel which is adjacent but spaced from the heating surface.

17 Claims, 5 Drawing Sheets

YARN HEATING APPARATUS

BACKGROUND OF THE INVENTION

The present invention relates to a heating apparatus for heating an advancing yarn and which is particularly adapted for use in a yarn false twist crimping machine.

Heating apparatus of the described type are known from both German OS 23 14 975 and British Patent 890,057. In these known heating apparatus, the yarn is guided along a heated surface, which has a temperature substantially higher than the target temperature of the yarn, the target temperature of the yarn being the temperature to which the yarn is to be heated. Such heating apparatus are used primarily in yarn false twist crimping machines for crimping synthetic filaments yarns, with the target temperature ranging from 150° to 230° C. The temperature of the surface is substantially higher than 300° C.

In the known heating apparatus, the yarn is guided by spaced-apart yarn guides at a distance from the heated surface. The arrangement of the yarn guides along a convexly curved line permits a full contact of the yarn with the yarn guides and a smooth threadline.

However, it has been found that the looping angle of the yarn on each individual yarn guide as well as the sum of the looping angles are very significant for the smoothness of the yarn path and the amount of the false twist to be imparted to the yarn. In the known heating apparatus, however, the predetermined looping angle and the total looping angle also influence the distance of the yarn from the heating surface.

It is accordingly an object of the present invention to guide a yarn along the heating apparatus, in such a manner that it becomes possible to freely select the looping angle on the yarn guides and the sum of the looping angles on all yarn guides, without it being necessary to also influence the distance of the yarn path from the heating surface.

SUMMARY OF THE INVENTION

The above and other objects and advantages of the present invention are achieved in the embodiments illustrated herein by the provision of a yarn heating apparatus which comprises an elongate heating surface, means for heating the heating surface, and yarn guide means interdigitally disposed along the length of the heating surface for engaging opposite sides of an advancing yarn and guiding the same along the heating surface in a laterally zigzagged path of travel which is adjacent but spaced from the heating surface along the entire length thereof.

In the preferred embodiment, the yarn guide means comprises a plurality of guide members which are mounted in a longitudinally spaced-apart arrangement along the heating surface, and the guide members support the yarn at a substantially uniform distance from the heating surface along its entire length.

The present invention has the advantage that by guiding the yarn in a zigzag course along the heating surface, the yarn path is also lengthened or respectively the heater length may be shortened, while the dwelling time of the yarn on the heating surface remains the same.

The yarn guidance along the heater with a varying separation, as is known from the prior art, has in particular the disadvantage that the transfer of the heat between the heater and the yarn is dependent on the distance of the yarn from the heater. However, this dependence is influenced by the temperature. It would therefore be necessary to separately adjust the distance between the yarn and the heater for each desired temperature of the heater. This requirement would, under certain circumstances, have a detrimental influence on the looping angles. This disadvantage is avoided with the present invention.

A precise adjustment of the distance of the plane of the yarn path from the heated surface or respectively heating plane of the heater is also permitted with the present invention. Further, it is desirable, both from a manufacturing standpoint and for the operation, that the heating surface be planar, in particular a flat plate, which avoids the use of the previously used, curved hot plates.

A favorable heat conduction can be achieved by designing the heating apparatus so as to comprise a body member having an elongate channel therein, and positioning the yarn so as to run through the elongate channel. The channel is then adapted to mount several, spaced-apart yarn guide members, one succeeding the other. In one embodiment, the guide members may be arranged symmetrically to the central plane of the channel and the guide members have fork-shaped yarn receiving slots which are arranged asymmetrically thereto. In another embodiment, the guide members may be arranged asymmetrically to the central plane of the channel, and with the yarn receiving slots being symmetrical with respect to the guide members but asymmetrical with respect to the central plane. This results in an offset arrangement of the yarn guiding edges of the fork-shaped yarn receiving slots relative to the central plane in such a manner that the yarn is guided along a zigzag path extending through the central plane.

As has been indicated above, the looping angles on the individual yarn guides as well as the sum of the looping angles are highly significant for the quality of the textured yarn. To obtain good qualities, it is preferred that the number and the spacing of the yarn guides relative to each other be selected in such a manner that the total looping angle (i.e. the angle equal to the sum of the looping angles which are present on the individual yarn guides), be between about 6° and 40°. Preferably, the total looping angle is between 7° and 30°. In applying this criteria for proportioning the lateral displacement between the yarn receiving slots of successive guide members, it is necessary to consider for synthetic yarns with a denier ranging from 15 to 44 dtex, in particular nylon hosiery yarn, the entire range for the factor F as defined below, and which preferably ranges from 0.01 to 0.1. However, it is possible to select a short overall length of the heating apparatus according to the lesser heat requirement. Longer heating apparatus are necessary for synthetic yarns with a denier ranging from 55 to 500 dtex, in particular polyester yarns and nylon yarns of an intermediate denier. The selection of the factor F within the indicated range permits the sum of the looping angles to be within the desired range as indicated above.

In a preferred embodiment, the heating apparatus comprises two or more heaters, with the heating planes being slightly inclined relative to each other and so that the running planes of the yarns are each parallel to the heating surfaces. This construction achieves a smooth yarn path, and a high level of twist.

Depending on the length of the entire heating apparatus it will suffice that the heating apparatus is composed of two or three heater segments. The angle of inclination between the individual heater segments is small and preferably amounts to about preferably 1° to 10°.

The heating apparatus may be composed of two or more parallel channels for processing several yarns, and with each of the channels being closed by separate door. This insures good heat conduction and avoids heat losses.

To facilitate the threadup of the yarn, the fork-shaped yarn receiving slots form on their open or outer end portion, when viewed in the direction of the advancing yarn, an open V which overlaps the central plane of the channel, and into which the yarn can be inserted without any difficulty.

The edge of the yarn receiving slot which is adjacent the central plane of the channel may be provided with a recess in the region of the bottom of the slot. This ensures that the yarn cannot move out of the yarn receiving slots. This embodiment is especially advantageous, when the heating apparatus comprises only a single heater as opposed to two heater segments inclined with respect to each other as described above.

The heating surface referred to in the foregoing description may, for example, be made of a highly heat resistant steel. Alternatively, the heating surface may comprise a ceramic plate with a resistance heater embedded therein. The use of a ceramic plate is desirable by reason of its low manufacturing cost.

The heating apparatus may alternatively be in the form of a tube which is heated, and to which several spaced-apart yarn guide members are attached. The yarn guide members are adapted to be rotated and locked in position, and they are provided with yarn receiving slots, each having radially directed deflecting edges. This embodiment has the advantage that the displacement of the yarn guide members, and thus, the amplitude of the zigzag line is adjustable at any time. In this regard, the tube may be closed and be partially filled with a heat-carrying fluid, and the fluid is heated until it evaporates. This embodiment also ensures a good temperature stability over the entire length of the heater, it being possible to regulate the pressure or temperature of the heat carrying fluid.

The latter embodiment also permits the heating apparatus to be adapted to different process parameters, such as, for example, the yarn speed, yarn denier, desired target temperature, or the like, by simple manipulations, without it becoming necessary to modify the structure of the textile processing machine.

The heating apparatus of the present invention is suitable in particular for heating the yarn in the twisting zone of a false twist crimping machine, it becoming possible to operate the false twist crimping machine at high yarn speeds with a high twist insertion and a correspondingly high crimp, and to crimp also coarse yarn deniers economically and satisfactorily.

The advantages claimed by other state of the art heating apparatus, in particular the self-cleaning effect of the heater, are also maintained with the yarn heating apparatus of the present invention.

BRIEF DESCRIPTION OF THE DRAWINGS

Some of the objects and advantages of the present invention having been stated, others will appear as the description proceeds, when taken in conjunction with the accompanying drawings, in which.

BRIEF DESCRIPTION OF THE PREFERRED EMBODIMENT

Figure 1:
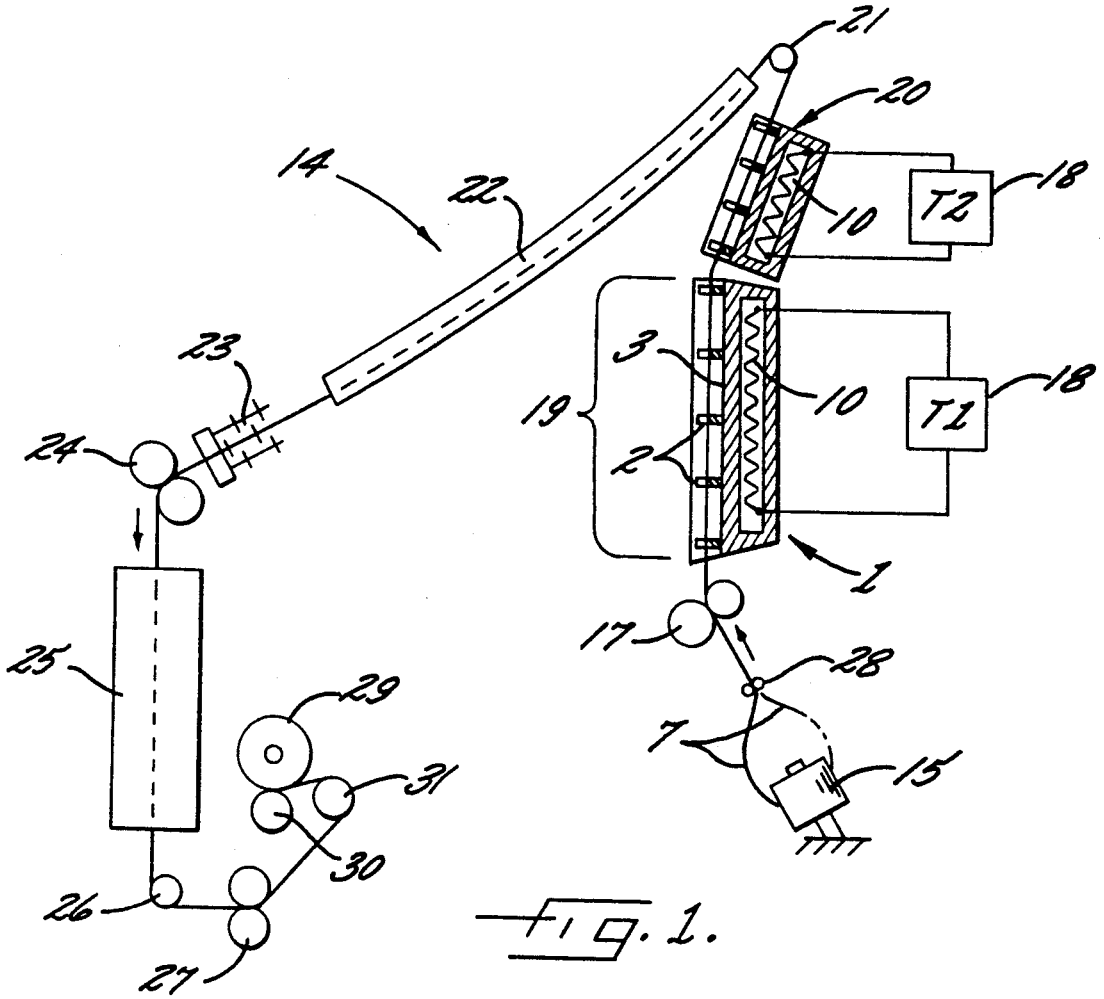
FIG. 1 is a schematic side elevation view of a yarn false twist crimping machine which embodies the heating apparatus of the present invention.

Referring more particularly to the drawings, FIG. 1 schematically illustrates a yarn false twist crimping machine. As illustrated, a yarn 7 is withdrawn from a supply package 15, via a yarn guide 28, by a feed system 17. The yarn then reaches a heater 1, which consists of two segments. The first segment 19 is heated to a temperature T1, while the second segment of the heater, which is described as end segment 20, heats the yarn to its target temperature. This end segment 20 is heated to a temperature T2. Downstream of the heater 1, a deflecting yarn guide 21 is provided, over which the yarn advances to a cooling plate 22 and then to a false twist unit 23. The yarn is withdrawn from the texturing zone by a feed system 24 and it may then be guided over a second heater 25, a deflecting guide 26, and feed system 27 to a takeup system which includes a package 29, a drive roll 30 and a traversing mechanism 31.

In all embodiments, the heating apparatus comprises a heater 1, which includes a plurality of yarn guide members 2. The yarn guide members 2 are crosspieces which extend parallel to each other on the heating surface 3 of the heater 1. The yarn guide members are in a heat conducting contact with the surface 3 of the heater 1, and the yarn guide members are arranged and dimensioned such that the yarn is guided in a laterally zigzagged path of travel along the heating surface 3 of the heater, thereby effecting a full contact of the yarn on the yarn guide members.

Figure 2:
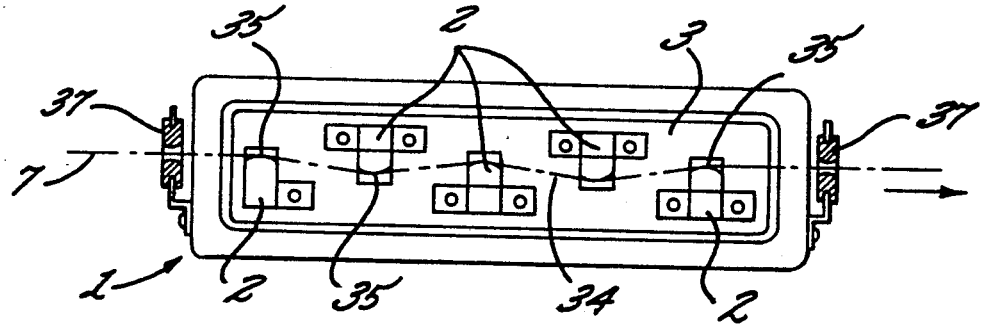
FIG. 2 is a front elevation view of the lower portion of the heating apparatus shown in FIG. 1.

FIG. 2 is a schematic view of a heating apparatus, in which a zigzagged path of travel is illustrated. On the heater 1, which is heated in a manner analogous to FIG. 1, yarn guide members 2 are bolted. The deflecting surfaces (heated surfaces) 35 of the yarn guide members 2 are arranged in such a manner that they deflect the yarn 7 along a zigzag line 34, i.e. the deflecting surfaces which are arranged side by side and opposite to each other, interengage in the fashion of a lattice and guide the yarn such that its follows a zigzag line with the yarn guide members 2 on the deflecting points.

Stated in other words, the guide members 2 are interdigitally disposed along the length of the heating surface and engage opposite sides of the advancing yarn to guide the same along the heating surface in a laterally zigzagged path of travel which is adjacent but spaced from the heating surface along the entire length thereof. As a result of having the yarn advance along the zigzag line, the length of the heater is shortened or the dwelling time of the yarn on the heater is increased respectively. An inlet and an outlet yarn guide 37 supplies the yarn to the first and last deflecting surfaces 35 respectively.

The guidance of the yarn in a zigzag line means that the yarn extends in a surface and, preferably, in a plane (i.e. running surface or running plane). This running surface is spaced a substantially uniform distance from the surface 3 of the heater 1 at all points of the yarn path, with the yarn guide members 2, which define the zigzag line having a deflecting edge or deflecting surface 35, which is shown in FIG. 2 and described with reference thereto, and extends perpendicularly through the plane of the advancing yarn.

Figure 3:
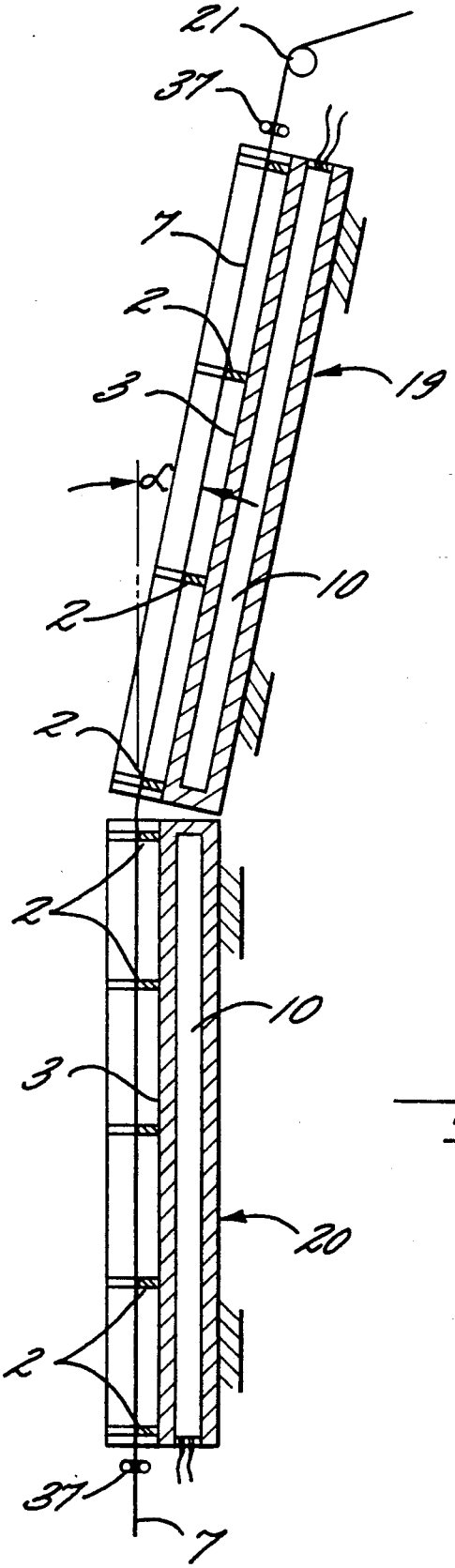
FIG. 3 is an enlarged sectional side elevation view of a heating apparatus in accordance with the present invention.

The heaters of FIGS. 3–5, which are described below, correspond to the heater which is only schematically illustrated in FIG. 1. As best seen in FIG. 3, the heating apparatus comprises two individual heater segments 19, 20, which have substantially the same design. Each heater segment is a parallelpiped, elongate body. Cut into a longitudinal surface of each segment are two rectangular channels 8, 9 which extend parallel to each other. More particularly, each channel is of generally rectangular cross-section as seen in FIG. 5, and includes a bottom wall and parallel opposite side walls. Also, a central plane 6 is defined for each channel, and which is parallel to and equally spaced between the opposite side walls.

In the central plane which is defined between the two channels, a heating chamber 10 extends through each segment. This heating chamber preferably mounts a resistance heater. The resistance heater of each heater segment 19, 20, is connected to a controller 18, as is shown in FIG. 1 and described with reference thereto. Inserted into the channels 8, 9 are several equally spaced-apart yarn guide members 2 in the form of flat plates, i.e. four yarn guide plates 2 in the first segment 19 and five yarn guide plates 2 in the second segment 20. One yarn guide plate is located at each of the inlet and the outlet ends of each segment 19 and 20. For their installation in the channels 8, 9, the channels are provided with aligned pairs of guideways 5 formed in the opposite side walls of each channel, with each aligned pair of guideways 5 receiving the opposite side edges of one of the plates therein. This permits the yarn guide plates 2 to be mounted in planes which extend transversely to the central plane 6. In the illustrated embodiment the guideways 5 have a width in the longitudinal direction which corresponds substantially to the thickness of the yarn guide plates. However, it is also possible to form the guideways as cylindrical bores in the channel, whose diameter corresponds to the width of the yarn guide plates.

In the embodiment illustrated in FIG. 5, the channels each define a central plane 6 as defined above, and consequently, the yarn guide members are asymmetrical in the width direction. The cross-sectional view of FIG. 5 shows differently designed yarn guide members for the channels 8 and 9. This serves only for the description of different embodiments, and in actual practice, only one type of yarn guide member would be used in a given heating apparatus.

The yarn guide members 2 illustrated on the right side in FIG. 5 are each rectangular plates. Inserted into each of these plates is a slot 16 which is offset from the central plane 6. The slot extends parallel to the central plane 6 of channel 9, but it is positioned at a lateral distance from the central plane. Successive yarn guide members 2 are alternately positioned with respect to the central plane 6. Consequently, the slots 16 of successive yarn guide members 2 are alternately positioned on the one and the other side of the central plane 6, with the edges of the slots 16 which are adjacent the central plane forming the deflecting surfaces 35, on which the yarn is deflected to a zigzag course. The edges of each slot 16 diverge near its entry end into a V-shape, with the opening width of the V being so large that the edges of successive yarn guide members 2 adjacent the central plane 6 overlap, when viewed in the direction of the advancing yarn, and form a line of V-shaped openings, into which the yarn can be inserted in a straight line.

The yarn guide members 2, which are shown on the left side of FIG. 5, comprise yarn retaining slots 16, which prevent the yarn from moving out of the channel. The yarn guide members are again made of flat, rectangular plates. The slot formed in each of the plates is at a location which is asymmetrical to the central plane 6. The edge adjacent the center of the width or central plane 6 terminates at its bottom in a recess 32, which forms the deflecting surface 35. The other lateral edge of each slot 16 extends more or less parallel to the central plane 6 of the channel. The edge adjacent the central plane 6, however, penetrates through the central plane 6 of the channel. It should be added that the recess 32 is laterally displaced with respect to the central plane 6. Successive yarn guide members 2 are each alternated in its orientation during installation, and as a result, the recesses 32 of successive yarn guide members are alternately located on the one and on the other side of the central plane 6.

The channel of each heater segment 19, 20 is closed by a cover 13, and in addition, each heater is surrounded by a suitable external insulation not shown. Noteworthy is the fact that each channel 8, 9 is closed by its own cover. Consequently, it is necessary to open only that channel which needs maintenance and service.

As noted above, the heating apparatus comprises two aligned heater segments 19 and 20. As is shown in FIG. 3, these heater segments 19, 20 are inclined relative to each other by an angle alpha. This measure will also suffice, when the yarn guide slots 16 are not provided with yarn retaining recesses, as is shown in FIG. 5 on the right side, so as to ensure a smooth advance of the yarn. The angle alpha should be greater than 1°, and is preferably smaller than 10°.

Figure 4:
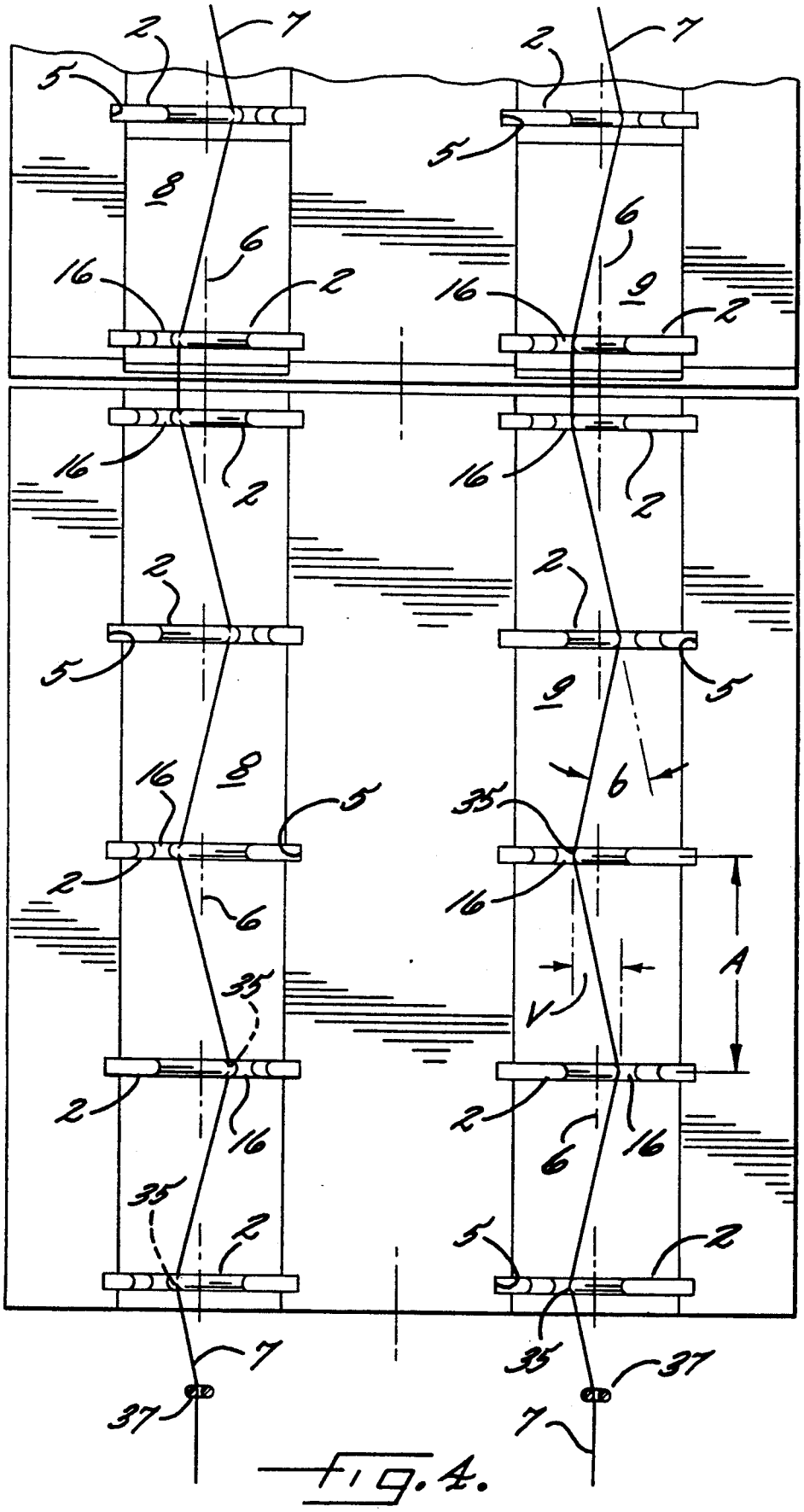
FIG. 4 is a fragmentary front elevation view of the heating apparatus of FIG. 3.
Figure 5:
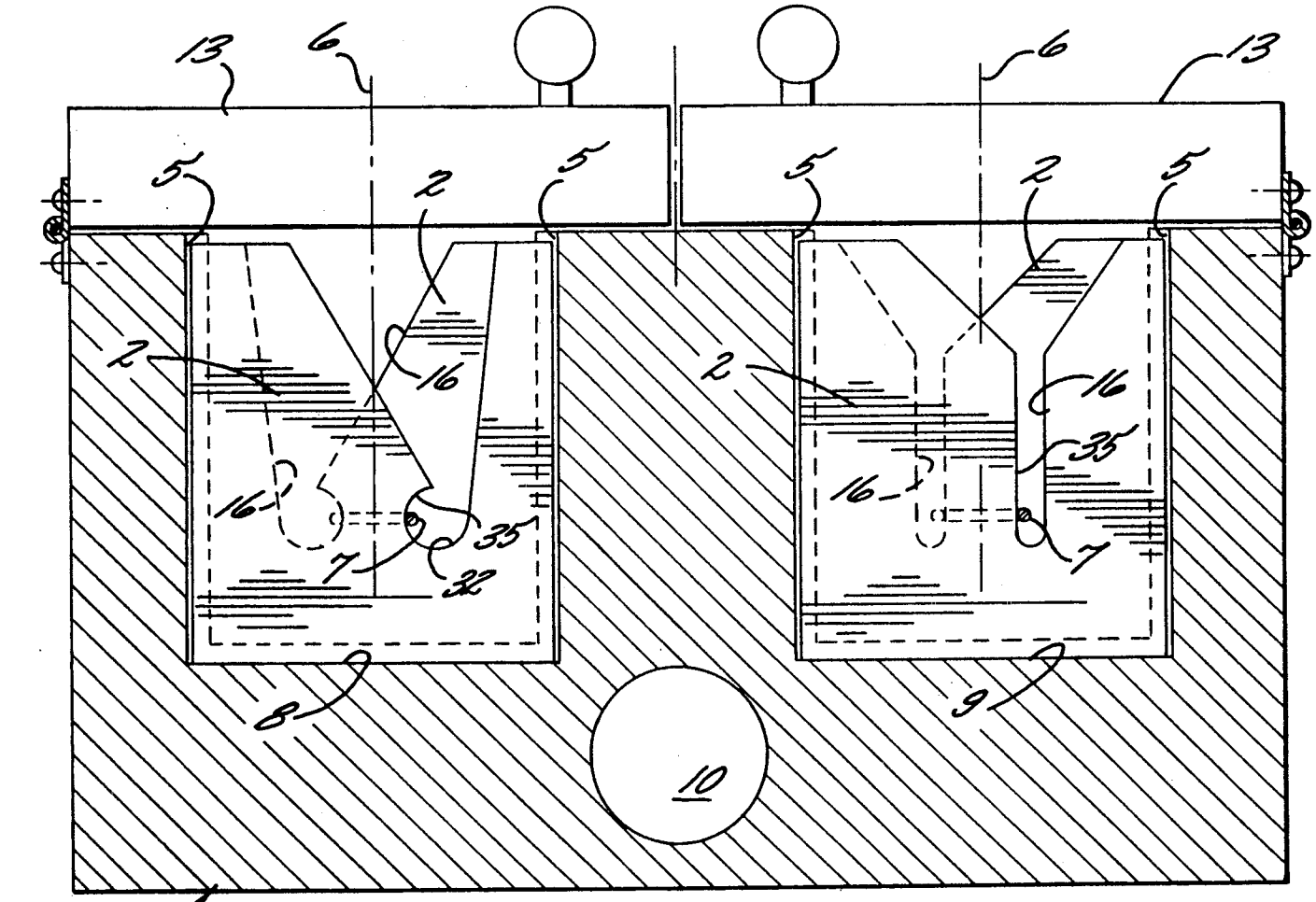
FIG. 5 is a sectional plan view of the apparatus shown in FIGS. 3 and 4.

FIG. 4, which is a side view of the heater segments looking into the channels 8, 9 (the covers are omitted in the drawing for a better illustration), shows that the displacement V of the zigzag line between successive yarn guide members is the distance between successive deflecting surfaces 35, the displacement V being measured perpendicularly to the central plane 6 of the channel. To measure this displacement, the sum of looping angles b (which are shown in exaggeration in FIG. 4) on the deflecting edges is predetermined to be between 6° and 40°. To this end, it is necessary to determine first the length which each heater segment 19, 20 needs to have. This length is dependent on the process parameters, in particular the type of yarn, yarn thickness, yarn speed, temperature of the heaters, dimensioning of the heating apparatus. For example, assuming that the overall length is to be 1 meter, each heater segment 19, 20 will have a length of 500 mm. It has shown that it is useful to arrange four yarn guides on the first heater segment 19 and five on the second heater segment 20. Thus, if a detailed calculation is made for the second heater segment 20 as an example, a spacing A between the individual yarn guides of 125 mm will result when measured in the longitudinal direction of the heater. When taking into account the aforesaid angle correlation, the following formula will result for the displacement: $V=F\times L/(N-1)$, wherein V = displacement of the deflecting surfaces 35 respectively = amplitude of the zigzag line = 2 × displacement of the deflecting surfaces 35 from the central plane 6 of the channel;

F = factor from 0.01 to 0.1;

L = length of the heating member; and

N = number of yarn guides over the length of the heating member.

The desired total looping angle will result when the specified factor with the initially discussed adaptation to the yarn type is taken into account. The displacement is typically about 1 mm or less.

Figure 6:
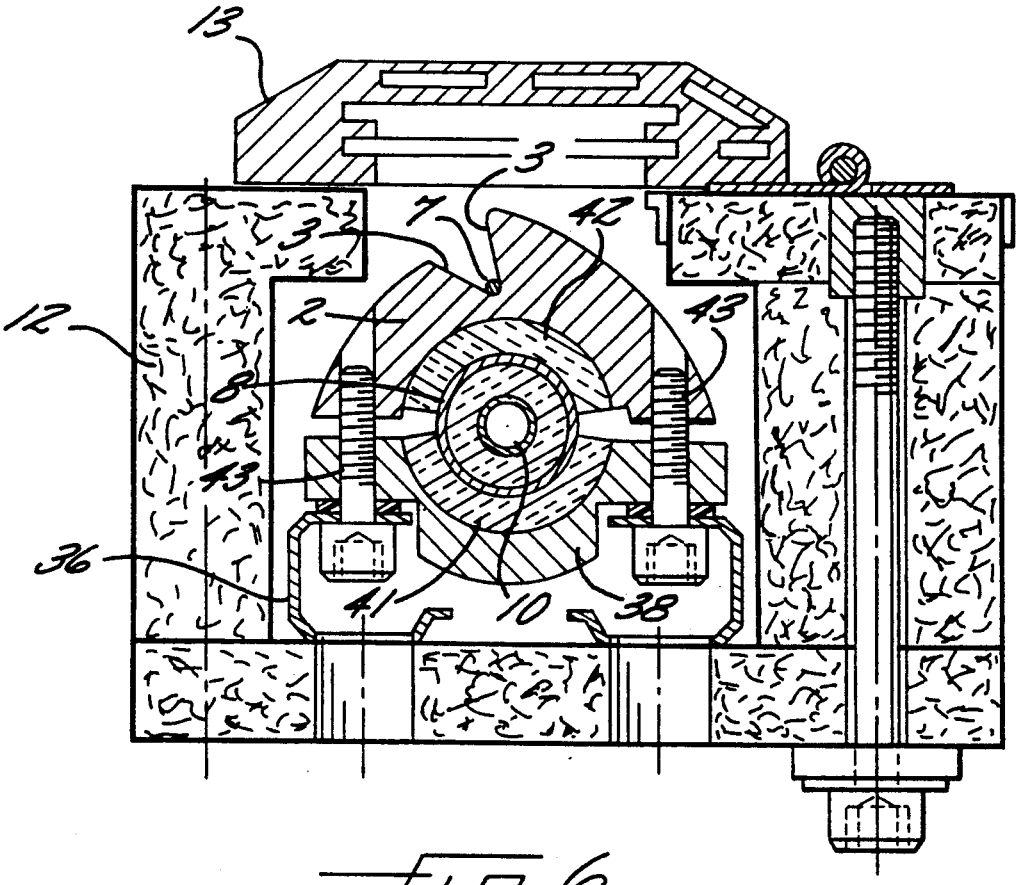
FIG. 6 is a section plan view of a further embodiment of the invention.
Figure 7:
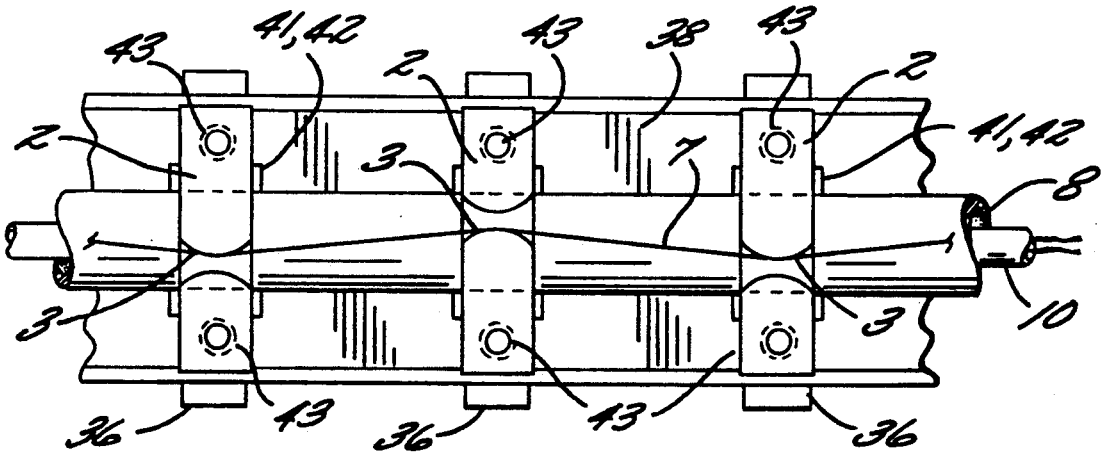
FIG. 7 is a front elevation view of the embodiment of FIG. 6, with the cover and insulating box removed for clarity.

FIG. 6 is an enlarged cross sectional view of a further embodiment of heating apparatus in accordance with the present invention, and FIG. 7 is a front elevation view of this embodiment. In this embodiment, the heater is a hollow tube 8 enclosing a hollow space and a heating member 10, and which is positioned in an insulated box 12 with a cover 13. The heating member 10 is designed similarly to the one shown in FIGS. 1 to 5, and it comprises an electrical heating resistant extending lengthwise in the tube and secured to the ends of the tube. The tube is closed at its ends so as to enclose a hollow space which is filled with a suitable heating fluid or the vapor thereof. The tube is embedded in a suitably shaped beam 38 extending along the tube. The beam 38 is secured by means of screws 43 to mounting means 36 mounting the beam in an insulated box 12 with a cover 13. The tube rests in the beam in an insulating member 41, in order to prevent the beam from being heated.

The screws 43 for securing the beam 38 to the mounting members 36 also serve to fix the guide members 2 to the tube. The guide members 2 have an inner surface which does not enclose the whole of the periphery of the tube which is left by the beam and the insulating member 41. The guide member 2 mates with an insulating member 42 which is laid upon said tube. The guide member 2 also partially receives the insulating member 42. It should be noted that the structure composed of the beam 38 and insulating member 41, on the one hand, and the guide member 2, plus the insulating member 42, on the other hand, does not completely enclose the tube with the insulating members 41, 42 thereupon. More particularly, there is a space between the opposed flanges of the beam 38, on the one hand, and the guide member 2, on the other hand. By rotational adjustment of one of the screws 43, the guide member 2 can be tilted, i.e. rotated, with respect to the tube in either direction.

Each guide member 2 has a V-shaped slot, the flanks 3 of which serve as heating surfaces. This slot is arranged off-center, and the yarn 7 can be inserted in said slot when the cover 13 of the insulated box 12 is open.

It is possible now, by adjusting the screws 43, to have the guide members 2 tilted in different directions, so that the slot of each guide member is slightly offset with respect to the slot of the preceding and the following guide members such that the yarn inserted in said slots follows a laterally zigzagged path corresponding to the one shown in FIG. 7.

In the drawings and specification, there has been set forth a preferred embodiment of the invention, and although specific terms are employed, they are used in a generic and descriptive sense only and not for purposes of limitation.

That which is claimed is:

1. An apparatus for heating an advancing yarn, comprising:

an elongate heating surface, means for heating the heating surface, and yarn guide means comprising a plurality of guide members mounted in a longitudinally spaced apart and interdigitally disposed arrangement along the length of said heating surface for engaging opposite sides of an advancing yarn and guiding the same along the heating surface in a laterally zigzagged path of travel which is adjacent but spaced form said heating surface along the entire length thereof.

2. The yarn heating apparatus as defined in claim 1 wherein said yarn guide means supports the advancing yarn at a substantially uniform distance from said heating surface along the entire length thereof.

3. The yarn heating apparatus as defined in claim 1 wherein said guide members are mounted to be in direct contact with said heating surface.

4. An apparatus for heating an advancing yarn, comprising:

a body member having an elongate channel therein, a heating surface positioned in said channel and extending along the length thereof, means for heating said heating surface, and yarn guide means comprising a plurality of guide members, and means mounting said guide members in a longitudinally spaced apart and interdigitally disposed arrangement in said channel for engaging opposite sides of an advancing yarn and guiding the same along the heating surface in a laterally zigzagged path of travel which is adjacent but spaced from said heating surface.

5. The yarn heating apparatus as defined in claim 4 wherein said channel is of generally rectangular cross section and defines parallel opposite side walls, a bottom wall, and a central plane which is parallel to and equally spaced between said opposite side walls, and wherein said guide members are generally flat plates, with said plates each including a yarn receiving slot, with the center lines of the slots of adjacent plates being positioned on opposite sides of said central plane.

6. The yarn heating apparatus as defined in claim 5 wherein said slots each include a generally V-shaped outer end portion, and such that one edge of said V-shaped outer end portion intersects said central plane.

7. The yarn heating apparatus as defined in claim 5 wherein said means mounting said guide members in said channel comprises a plurality of aligned pairs of guideways formed in said opposite side walls of said channel, with each aligned pair of guideways receiving the opposite side edges of one of said plates therein.

8. The yarn heating apparatus as defined in claim 5 wherein said slots of said plates are configured to include a recess located on the edge of the slot adjacent said central plane and adjacent the bottom of the slot, and such that the advancing yarn is received and retained in said recess during its advance along said heating surface.

9. The yarn heating apparatus as defined in claim 5 wherein the number and longitudinal spacing of said guide members relative to each other are predetermined such that the sum of the looping angles of the yarn about all of said guide members is between about 6 and 40 degrees.

10. The yarn heating apparatus as defined in claim 4 wherein said channel is of generally rectangular cross section and defines parallel opposite side walls and a bottom wall, and said channel further defines a central plane which is parallel to and equally spaced between said opposite side walls, and wherein said body member comprises two segments which are longitudinally aligned with each other when viewed in a direction along said central plane but are inclined with respect to each other when viewed in a direction perpendicular to said central plane.

11. The yarn heating apparatus as defined in claim 10 wherein said heating surface is composed of respective segments which are similarly inclined with respect to each other.

12. The yarn heating apparatus as defined in claim 4 wherein said heating surface is composed of a ceramic plate, and wherein said heating means is embedded in said plate.

13. The yarn heating apparatus as defined in claim 4 wherein said heating surface is in the form of a tube, and wherein said yarn guide means comprises a plurality of guide members, and means mounting said guide members to said tube in a longitudinally spaced apart arrangement and such that each guide member may be locked to said tube in a predetermined rotational position.

14. The yarn heating apparatus as defined in claim 13 wherein each of said guide members further comprises a generally radially directed yarn receiving slot.

15. A yarn heating apparatus as defined in claim 4 further comprising a door pivotally mounted to said body member so as to permit said channel to be selectively closed.

16. A yarn false twist crimping machine for processing synthetic yarn and comprising yarn heating means, yarn cooling means, yarn false twisting means, and means for advancing a yarn serially through said yarn heating means, said yarn cooling means, and said yarn false switching means and for winding the processed yarn into a package, said yarn heating means comprising an elongate heating surface, means for heating the heating surface, and yarn guide means comprising a plurality of guide members mounted in a longitudinally spaced apart and interdigitally disposed arrangement along the length of said heating surface for engaging opposite sides of an advancing yarn and guiding the same along the heating surface in a laterally zigzagged path of travel which is adjacent but spaced from said heating surface along the entire length thereof.

17. The yarn heating apparatus as defined in claim 16 wherein said yarn guide members support the advancing yarn at a substantially uniform distance from said heating surface along the entire length thereof.

* * * * *

UNITED STATES PATENT AND TRADEMARK OFFICE

CERTIFICATE OF CORRECTION

PATENT NO. : 5,148,666

DATED : September 22, 1992

INVENTOR(S) : Karl Bauer et al.

It is certified that error appears in the above-identified patent and that said Letters Patent is hereby corrected as shown below:

Column 8, line 14, "form" should be -- from --.

Column 10, line 13, "switching" should be -- twisting --.

Signed and Sealed this

Nineteenth Day of October, 1993

*Attest:*

*Attesting Officer*

BRUCE LEHMAN

*Commissioner of Patents and Trademarks*